United States Patent [19]

Riha

[11] 4,022,045

[45] May 10, 1977

[54] TUBE BENDING APPARATUS

[75] Inventor: Manfred Riha, Krefeld, Germany

[73] Assignee: Mannesmannrohen-Werke AG, Dusseldorf, Germany

[22] Filed: Mar. 18, 1976

[21] Appl. No.: 668,111

[30] Foreign Application Priority Data

Mar. 24, 1975 Germany ..... 2513561

[52] U.S. Cl. ..... 72/128; 72/307; 72/310; 72/318

[51] Int. Cl.[2] ..... B21D 7/16

[58] Field of Search ..... 72/128, 149, 154–157, 72/166, 172, 175, 306, 307, 369, 305, 310, 318

[56] References Cited

UNITED STATES PATENTS

| | | | |
|---|---|---|---|
| 785,083 | 3/1905 | Brinkman | 72/128 |
| 1,837,196 | 12/1931 | Berges et al. | 72/157 X |
| 2,286,893 | 6/1942 | Boissou | 72/342 |
| 3,724,258 | 4/1973 | Hofstede et al. | 72/128 X |
| 3,731,513 | 5/1973 | Kindermann et al. | 72/316 X |
| 3,896,649 | 7/1975 | Stuart | 72/128 |
| 3,902,344 | 9/1975 | Stuart | 72/128 |

FOREIGN PATENTS OR APPLICATIONS

| | | | |
|---|---|---|---|
| 1,209,667 | 3/1960 | France | 72/166 |
| 1,962,590 | 6/1971 | Germany | 72/157 |
| 2,001,827 | 7/1971 | Germany | 72/149 |

*Primary Examiner*—E. M. Combs
*Attorney, Agent, or Firm*—Cullen, Settle, Sloman & Cantor

[57] ABSTRACT

A tube bending apparatus has a bed, a reciprocal feed carriage, power means to reciprocate the carriage, a first guide means at one end of the bed to receive the outer end of a first tube to be bent, mounted on said bed. Said apparatus includes a heating element on said bed outwardly of said first guide means adapted to surround the tube. The carriage is adapted to operatively engage the inner end of the tube for moving it outwardly of the bed. A bending arm at one end is pivotally mounted adjacent said one end of said bed and has gripping elements thereon to operably engage the outer end of the tube. The present improvement comprises a second guide means at the other end of said bed adapted to alternately receive the outer end of a second tube. A second heating element is mounted on said bed outwardly of said second guide means. A second bending arm at one end is pivotally mounted adjacent the other end of said bed and includes gripping elements to operatively engage the outer end of a second tube insertable upon said bed after initial bending of said first tube. The carriage on movement in the opposite direction operatively engages the inner end of the second tube alternately projecting it outwardly of the bed.

6 Claims, 3 Drawing Figures

TUBE BENDING APPARATUS

The invention relates to a tube bending apparatus having a feed or advancing arrangement capable of moving rectilinearly in a guide arrangement and acting on one end of the tube, having at least one bending arm which is pivotable about a pivot joint and which comprises clamping elements acting on the other end of the tube, and having a heating arrangement which is situated at the end of the guide arrangement and surrounds the tube at the bending region.

The invention has as its object to provide a bending apparatus which allows alternate bending and setting up at the two sides of the apparatus over large diameter ranges.

To achieve this object, according to the invention a bending apparatus is proposed which is characterised in that at the other end of the guide arrangement there is situated a further heating arrangement, that at least one further bending arm is associated with this heating arrangement, and that the feed arrangement is arranged between the opposite heating arrangements and is constructed to act on one end of a tube at a time in both directions of movement.

The bending apparatus according to the invention achieves a considerable increase in the output of the machine, since already during the bending of one tube a second tube can be inserted at the other side of the feed arrangement in the machine bed and clamped securely in position. After the bending operation is completed, by reversing the feed arrangement and changing-over the energy source to the heating arrangement at the opposite side it is possible to begin at once with the bending of the next time.

An important advantage of the apparatus according to the present invention consists in that by the arrangement of a plurality of bending arms which are designed for various tube dimension ranges and bending radii it is possible to bend tubes in an unusually large range of dimensions on a single bending apparatus. Thus it is possible to bend tubes of dimensions ranging from small to very large both with small and with large bending radii.

The accompanying drawings show in diagrammatic manner possible constructional forms of the bending apparatus according to the present invention.

Figure 1:
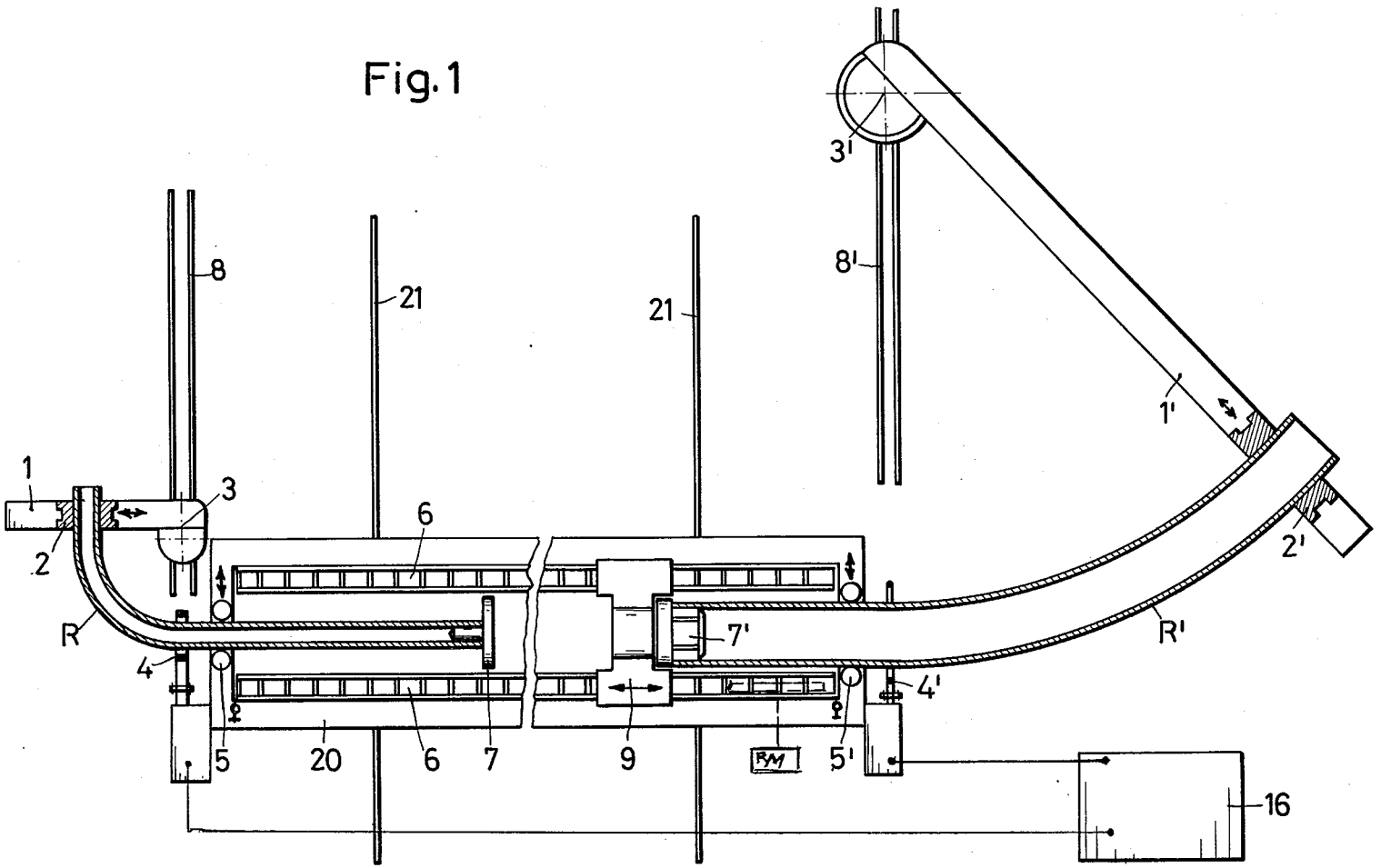
FIG. 1 shows an installation in plan view.

In FIG. 1, the bending arm 1 has bent the tube R through 90° about the pivot point 3. The adjustable clamping elements 2 are arranged interchangeably in the bending arm 1. The tube is heated during the bending operation in known manner by the heating arrangement 4. The tube is mounted on the machine bed 20 by adjustably spaced guide rollers 5 and a clamping arrangement 7.

At the opposite side a larger-diameter tube R′ is shown during a bending operation. In this case the feed carriage 9 which is capable of moving in both directions for example on chains 6, presses against the clamping arrangement 7′. The tube R′ is held by the adjustable clamping elements 2′ of the bending arm 1′ pivoting about the pivot point 3′ and heated after the adjustably spaced guide rollers 5′ during a bending operation by the heating apparatus 4′. A control device is provided in the energy source 16 for switching over the supply of energy from the heating arrangement 4 to the heating arrangement 4′ and vice versa.

The entire apparatus is capable of moving on rails, the machine bed 20 on rails 21 and the bending arms 1 and/or 1′ at their pivot points 3 and/or 3′ are adjustably mounted on the rails 8 and 8′.

Figure 2:
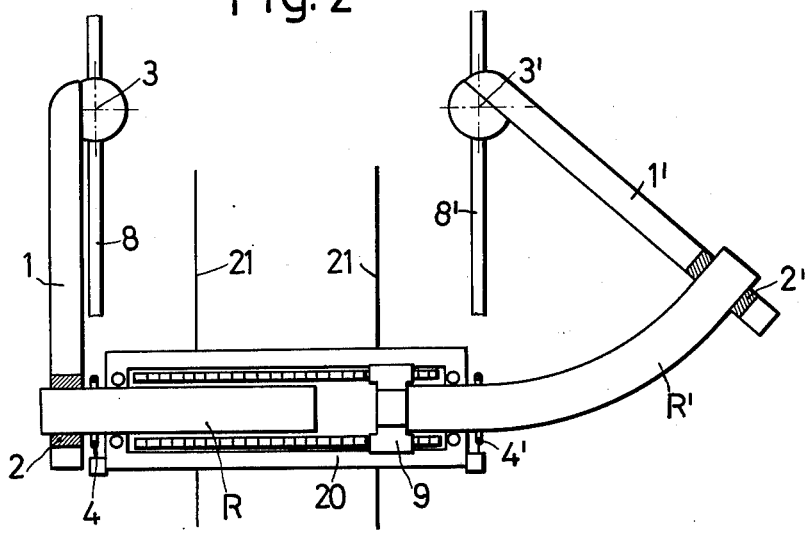
FIG. 2 shows an installation with two identical bending arms.

In FIG. 2 two bending arms 1 and 1′ of equal length are shown, the tube R being clamped in position whilst the tube R′ has already been bent.

Figure 3:
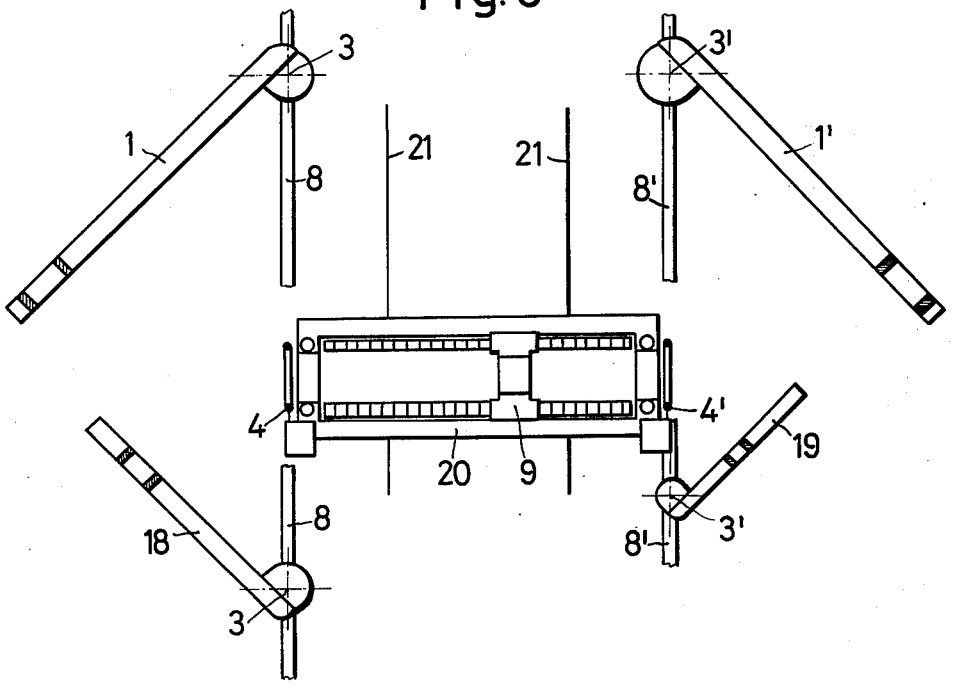
FIG. 3 shows an installation with four bending arms.

The layout shown in FIG. 3 shows two further bending arms 18 and 19 of different length in addition to the two identical bending arms 1 and 1′.

I claim:

1. In apparatus for bending tubes having inner and outer ends, having a bed, a feed carriage guidably mounted on the bed for rectilinear movements, power means to reciprocate the carriage, a first guide means at one end of the bed receiving the outer end of a first tube mounted on said bed to be bent; a heating element on said bed outwardly of said first guide means adapted to surround said tube at the bending region, said carriage on movement in one direction, on one side operably engaging the inner end of said tube for moving it outwardly of said bed in one direction, a bending arm at one end pivotally mounted adjacent said one end of said bed; and gripping elements on said bending arm operably engaging the outer end of said tube at said one end of said bed; the improvement comprising:

a second guide means at the other end of said bed adapted to alternately receive the outer end of a second tube to be bent;

a second heating element on said bed outwardly of said second guide means, adapted to surround the second tube at the bending region;

a second bending arm at one end pivotally mounted adjacent the other end of said bed;

gripping elements on said second bending arm, said second tube being insertable upon said bed after the initial bending of said first tube;

said carriage on movement in the opposite direction on its other side operably engaging the inner end of said second tube alternately projecting it outwardly of said bed in said opposite direction;

said gripping elements being adjustable on said bending arms for anchoring tubes of different diameter; and clamping elements mounted upon the inner ends of said tubes and alternately engageable by said carriage.

2. In the tube bending apparatus of of claim 1, said guide means each including a pair of upright adjustably spaced rollers mounted on said bed.

3. In the tube bending apparatus of claim 1, said power means including a motor-operated chain mounted on said bed connected to said carriage; said carriage being reciprocal between said guide means, and adapted to alternately act upon the inner ends of a pair of tubes to be bent.

4. In the tube bending apparatus of claim 1, an energy source including a control device connected to said heating elements for alternately energizing said heating elements.

5. In the tube bending apparatus of claim 1, the mounting of said bending arms including a pair of spaced rails extending at right angles to the direction of carriage movement; said bending arms at their pivot ends being adjustably mounted on said rails to provide a range of bending radii.

6. In the tube bending apparatus of claim 1, a third bending arm disposed opposite said first or second bending arm, upon the opposite side of said bed pivotally mounted at one end adjacent one end of said bed; and gripping elements adjustably mounted on said third bending arm adapted to operatively engage the outer end of a tube to be bent, whereby the bending apparatus may bend a large number of different size tubes over variable radii.

* * * * *